US007295983B2

(12) United States Patent
Fujiwara et al.

(10) Patent No.: US 7,295,983 B2
(45) Date of Patent: Nov. 13, 2007

(54) MUSICAL TUNE PLAYBACK APPARATUS

(75) Inventors: Yuji Fujiwara, Hamamatsu (JP); Haruki Uehara, Hamamatsu (JP); Shigeki Kawai, Hamamatsu (JP); Yasuhiko Oba, Hamamatsu (JP); Yoshihiro Shiiya, Inasa-gun (JP)

(73) Assignee: Yamaha Corporation, Shizuoka-Ken (JP)

( * ) Notice: Subject to any disclaimer, the term of this patent is extended or adjusted under 35 U.S.C. 154(b) by 868 days.

(21) Appl. No.: 10/447,116

(22) Filed: May 28, 2003

(65) Prior Publication Data

US 2003/0225582 A1 Dec. 4, 2003

(30) Foreign Application Priority Data

May 31, 2002 (JP) ..... 2002-160487

(51) Int. Cl.
*G10L 21/00* (2006.01)

(52) U.S. Cl. ..... 704/270; 84/600

(58) Field of Classification Search ..... 704/270
See application file for complete search history.

(56) References Cited

U.S. PATENT DOCUMENTS

| | | | | |
|---|---|---|---|---|
| 4,779,252 | A | 10/1988 | Custers et al. | |
| 5,986,979 | A | 11/1999 | Bickford et al. | |
| 6,243,725 | B1 | 6/2001 | Hempleman et al. | |
| 7,099,704 | B2 * | 8/2006 | Taniguchi et al. | 455/567 |
| 2001/0026287 | A1 * | 10/2001 | Watanabe | 345/764 |
| 2002/0161798 | A1 * | 10/2002 | Kanda et al. | 707/501.1 |

FOREIGN PATENT DOCUMENTS

| | | |
|---|---|---|
| JP | 01-217783 | 8/1989 |
| JP | 08-147949 | 6/1996 |
| JP | 10-222178 | 8/1998 |
| JP | 11-120198 | 4/1999 |
| JP | 11-283325 | 10/1999 |
| JP | 2000-251382 | 9/2000 |
| JP | 2001-075985 | 3/2001 |
| JP | 2000-268545 | 9/2002 |
| WO | WO97/05616 | 2/1997 |

OTHER PUBLICATIONS

Japanese Office Action dated Nov. 15, 2005.

* cited by examiner

*Primary Examiner*—Abul K. Azad
(74) *Attorney, Agent, or Firm*—Harness, Dickey & Pierce, PLC

(57) ABSTRACT

A musical tune playback apparatus is basically constituted by a controller (CPU), a digital media drive (e.g., a CD drive), a hard disk drive, and a sound system. Musical tune data recorded on a digital storage media (e.g., CD) are played back and are transferred to the hard disk drive together with relative information and/or image data. When a user inputs retrieval conditions, the controller retrieves musical tune data related to relative information (or image), which substantially matches retrieval conditions. Specifically, a relative information retrieval database is stored in a data area of the hard disk drive, wherein an auto-input area automatically describes an index ID, TOC information, and history information while a manual-input area describes other data and information with regard to each musical tune that is played back. Thus, desired musical tune data are automatically retrieved from the hard disk drive with reference to the database.

10 Claims, 8 Drawing Sheets

MUSICAL TUNE PLAYBACK APPARATUS

BACKGROUND OF THE INVENTION

1. Field of the Invention

This invention relates to musical tune playback apparatuses such as compact disk (CD) players.

2. Description of the Related Art

Various types of musical tune playback apparatuses have been presented worldwide and sold on the market, wherein playback apparatuses allow users to select musical tunes (or songs) recorded on recording media such as compact disks (CDs) for playback or reproduction. Playback apparatuses are generally designed in such a way that upon users' manipulation of operators (e.g., switches and controls), desired musical tunes are selected and are then played back.

However, the aforementioned playback apparatuses may have problems because users must select musical tunes every time they place compact disks into disk compartments (or onto turntables). Therefore, users should visually check musical tune lists printed on CD jacket covers and the like in order to confirm numbers of desired musical tunes among numerous musical tunes recorded on compact disks. When users cannot recall titles of compact disks that record desired musical tunes to be played back, they may have difficulties in selecting desired musical tunes. Even when users recall titles of compact disks that record desired musical tunes to be played back, they may have problems in searching for corresponding compact disks within numerous compact disks they possess. That is, it is very troublesome and inconvenient for users to select musical tunes from among numerous musical tunes or compact disks.

SUMMARY OF THE INVENTION

It is an object of the invention to provide a musical tune playback apparatus that reduces user's burden in selecting musical tunes from among numerous musical tunes.

A musical tune playback apparatus of this invention is basically constituted by a controller (e.g., CPU), a digital media drive (e.g., CD drive), a hard disk drive, and a sound system. Herein, musical tune data recorded on a digital storage media (e.g., CD) are played back and are transferred to the hard disk drive, wherein musical tune data are stored together with relative information and/or image data. When a user inputs retrieval conditions, the controller retrieves from the hard disk drive, musical tune data related to relative information (or image), which substantially matches retrieval conditions. Thus, retrieved musical tone data are read from the hard disk drive and are reproduced in the sound system.

Specifically, a relative information retrieval database is stored in a data area of the hard disk drive, wherein an auto-input area automatically describes an index ID, TOC information, and history information with regard to each musical tune that is played back, while a manual-input area describes other data and information that are manually input by the user with regard to each musical tune. Therefore, desired musical tune data are automatically retrieved from the hard disk drive with reference to the relative information retrieval database.

Thus, it is possible to noticeably reduce user's burden in selecting desired musical tunes from among numeral musical tunes stored in digital storage media and the like.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

A. Configuration

Figure 1:
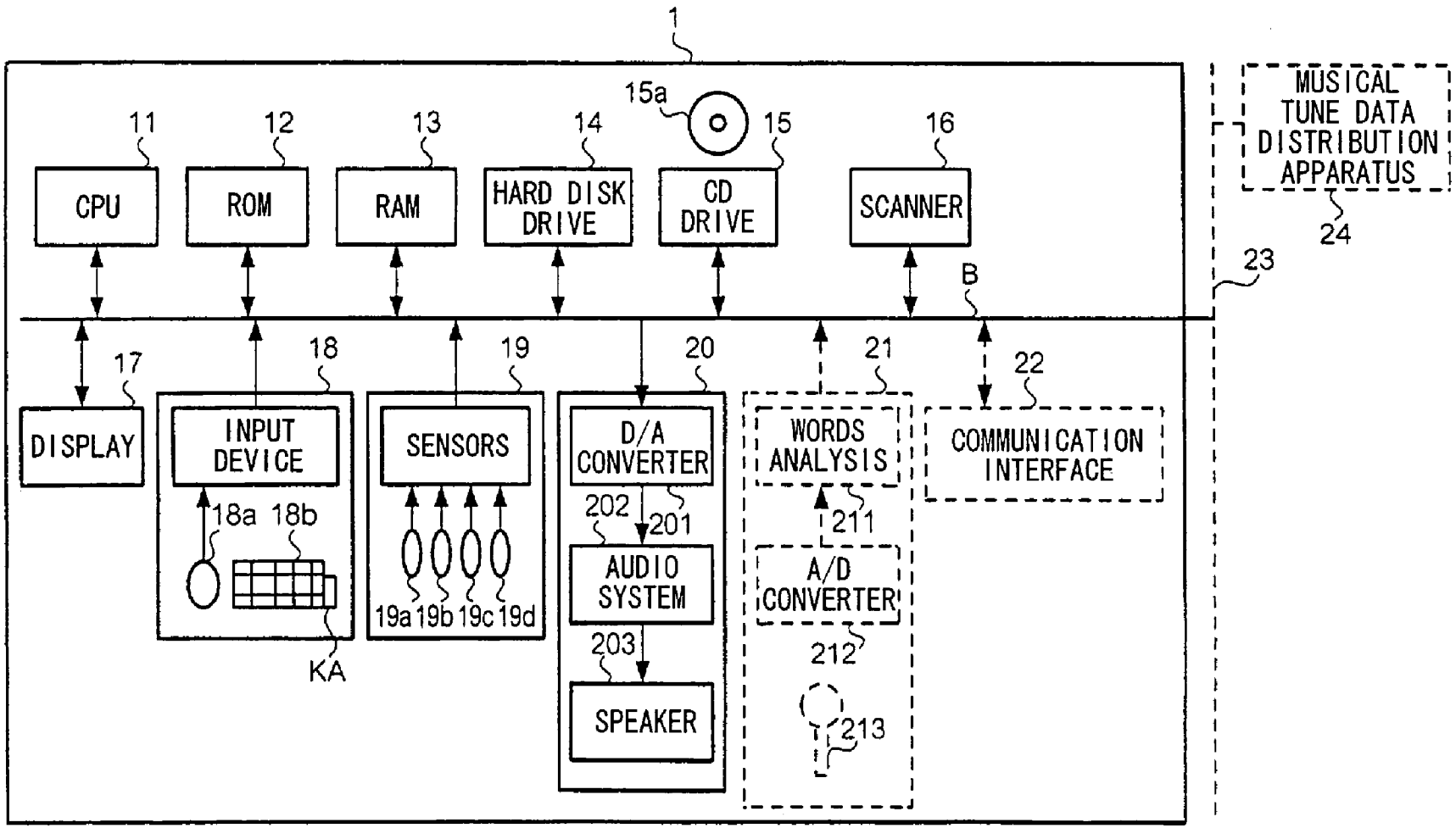
FIG. 1 is a block diagram showing the overall configuration of a musical tune playback apparatus in accordance with a preferred embodiment of the invention.

FIG. 1 is a block diagram showing the overall configuration of a musical tune playback apparatus in accordance with a preferred embodiment of the invention.

Reference numeral 1 designates a musical tune playback apparatus, wherein a CPU 11 controls various parts and blocks interconnected together via a bus B.

A ROM 12 stores a start program for starting the musical tune playback apparatus 1 when a power switch (not shown) is tuned on.

A hard-disk drive 14 contain one or more hard disks whose storage is divided into two areas, namely, a program storage area for storing programs such as a system program for controlling the musical tune playback apparatus 1 and an application program for instructing playback operations of musical tunes, and a data area for storing numerous musical tune data, image data related to musical tune data, and relative information regarding musical tunes, for example. Details of the data area of the hard disk drive 14 will be described later.

A RAM 13 temporarily stores the system program and application program that are read from the hard disk drive 14 when the CPU 11 loads the start program from the ROM 12. In addition, the RAM 13 temporarily stores various types of data as well.

A CD drive 15 reads musical tune data recorded on a compact disk (CD) 15*a* when inserted therein. The CD 15*a* stores musical tune data and prescribed information, namely, TOC (Table Of Contents). Musical tune data digitally represent waveforms of musical tones included in musical tunes. In the present embodiment, the CD 15*a* stores musical tune data with regard to a plurality of musical tunes in advance. The TOC information is constituted by various data regarding the content of the CD 15*a*, such as track numbers representing start points of musical tune data, playback times, and the like.

A display 17 is a cathode ray tube (CRT) display or a liquid crystal display, which displays various images and data shown in FIGS. 5, 6, 7, and 9 on the screen.

A scanner 16 scans visual materials such as photographs, pictures, paintings, illustrations to read and produce image data. The present embodiment allows the user to operate the scanner 16 to read an image from a photograph or a picture that may suit the jacket cover of the CD 15*a* or a desired musical tune.

An input device 18 comprises a pointing device such as a mouse 18*a*, and a keyboard 18*b* for inputting characters and symbols, wherein when operated by the user, corresponding signals are supplied to the CPU 11. Therefore, the user can enter playback instructions of musical tunes or relative information upon manipulation of the input device 18.

A sensor unit 19 contains various sensors, namely, a temperature sensor 19*a* for detecting temperature, a humidity sensor 19*b* for detecting humidity, a body temperature sensor 19*c* for detecting a body temperature of a human operator (e.g., a user), and a pulse sensor 19*d* for measuring the pulse (or a pulse count) of the human operator. Output signals of these sensors 19*a*-19*d* are read by the CPU 11.

A sound system 20 reproduces musical tune data to produce corresponding musical tones, wherein it comprises a digital-to-analog converter (D/A converter) 201, an audio system 202, and a speaker 203. The D/A converter 201 operates under the control of the CPU 11 to convert musical tune data supplied thereto from the CD drive 15 into analog musical tone signals, which are output to the audio system 202. The audio system 202 comprises an effector for imparting various effects (e.g., reverberation effect) to musical tones, and an amplifier for amplifying musical tone signals output from the D/A converter 201. Incidentally, it is possible to replace the speaker 203 with an earphone or a headphone set, which can be attached to user's ears.

Figure 2:
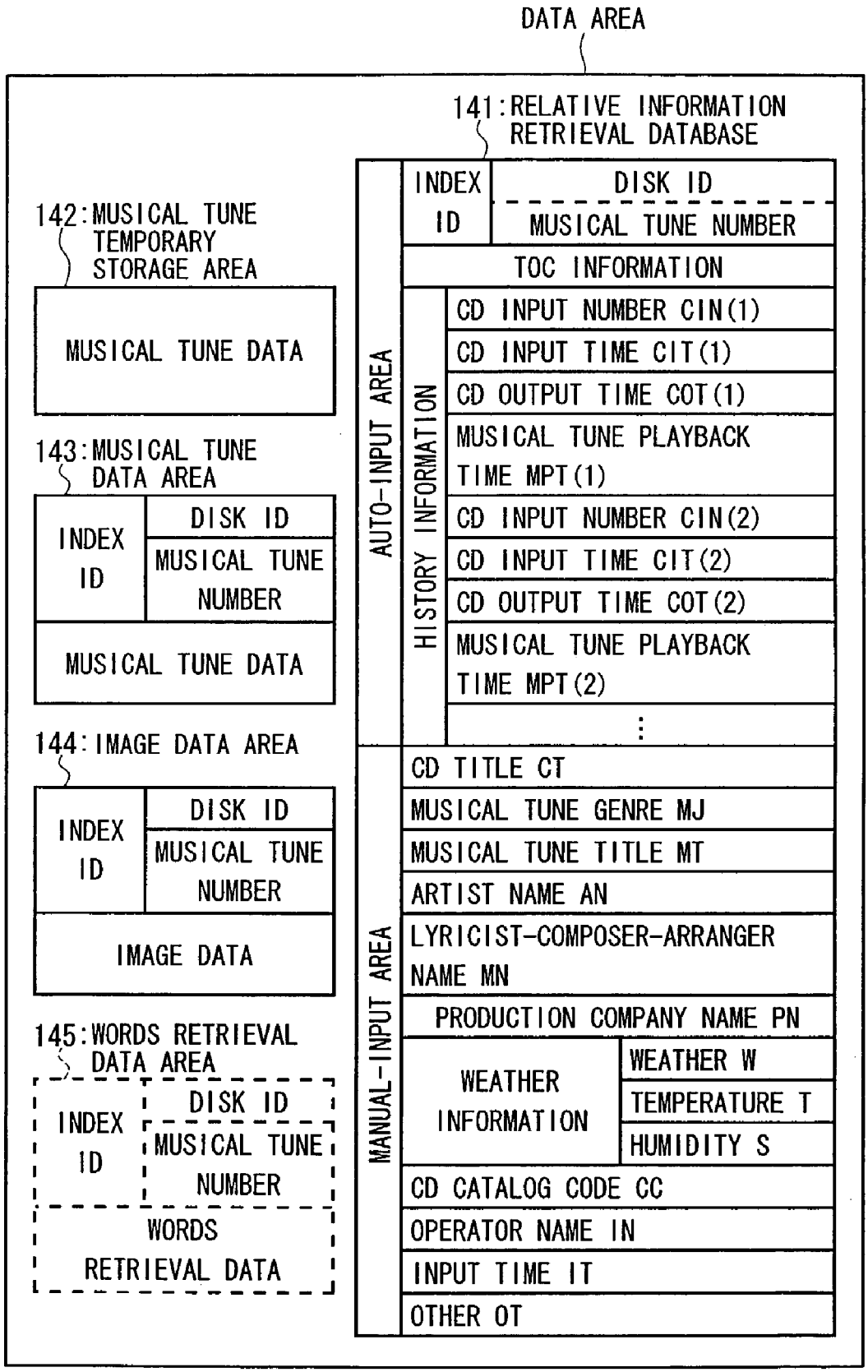
FIG. 2 shows the configuration of a data area of a hard disk drive shown in FIG. 1.

With reference to FIG. 2, a detailed description will be given with respect to the data area that is set in the hard disk drive 14. The data area of the hard disk drive 14 shown in FIG. 2 contains various areas, in which reference numeral 141 designates a relative information retrieval database that stores various types of relative information with regard to musical tune data. Specifically, the relative information retrieval database 141 stores index IDs representing identification information of musical tune data, TOC (Table Of Contents) information representing outlines of information stored in the CD 15*a*, and history information representing histories of the CD 15*a*, such as times in the past at which the CD 15*a* was inserted into the CD drive 15, the CD 15*a* was subjected to playback, and the CD 15*a* was ejected from the CD drive 15, for example.

In the above, each index ID is constituted by an identifier (hereinafter, referred to as a disk ID), which the CPU 11 directly assigns to the CD 15*a* storing musical tune data, and a serial number (hereinafter, referred to as a musical tune number) of musical tune data to be selected for playback from among plural musical tune data stored in the CD 15*a*. The index ID is created based on the TOC information stored in the CD 15*a*.

The history information contain a CD input number CIN representing a serial number of the CD 15*a* selected from among plural CDs installed into the CD drive 15, a CD input time CIT representing a timing at which the CD 15*a* is installed in the CD drive 15, a CD output time COT representing a timing at which the CD 15*a* is extracted from the CD drive 15, and a musical tune playback time MPT representing a timing at which a musical tune is started in playback. The history information is additionally stored in the data area of the hard disk drive 14 every time a musical tune of the same index ID is played back.

All the aforementioned pieces of information are automatically stored in the data area of the hard disk drive 14 when the CPU 11 executes a prescribed application program, wherein they are stored in an auto-input area of the relative information retrieval database 141.

As other pieces of information stored in the relative information retrieval database 141, there are provided a CD title CT, a musical tune genre MJ, a musical tune title MT, an artist name AN, a lyricist-composer-arranger name MN, a production company name PN, weather information (i.e., weather W, temperature T, and humidity S), a CD catalog code CC, an operator name IN, an input time IT, and other information OT, etc. Herein, the CD catalog code CC is defined by a thirteen-digit code, which is generally used in the market.

All the aforementioned pieces of information can be manually input into the hard disk drive 14 upon user's manipulation of the input device 18, wherein they are stored in a manual-input area of the relative information retrieval database 141.

Other than the aforementioned relative information retrieval database 141, the data area of the hard disk drive 14 provides a musical tune temporary storage area 142 for temporarily storing musical tune data of the CD 15*a*, a musical tune data area 143 for storing musical tune data selectively reproduced from the CD 15*a* together with index IDs, and an image data area 144 for storing image data loaded by the scanner 16 together with index IDs.

B. Operation

Next, the overall operation of the musical tune playback apparatus 1 of the present embodiment will be described in detail with reference to FIGS. 3 to 9.

1. Musical Tune Playback Process Using CD

Figure 3:
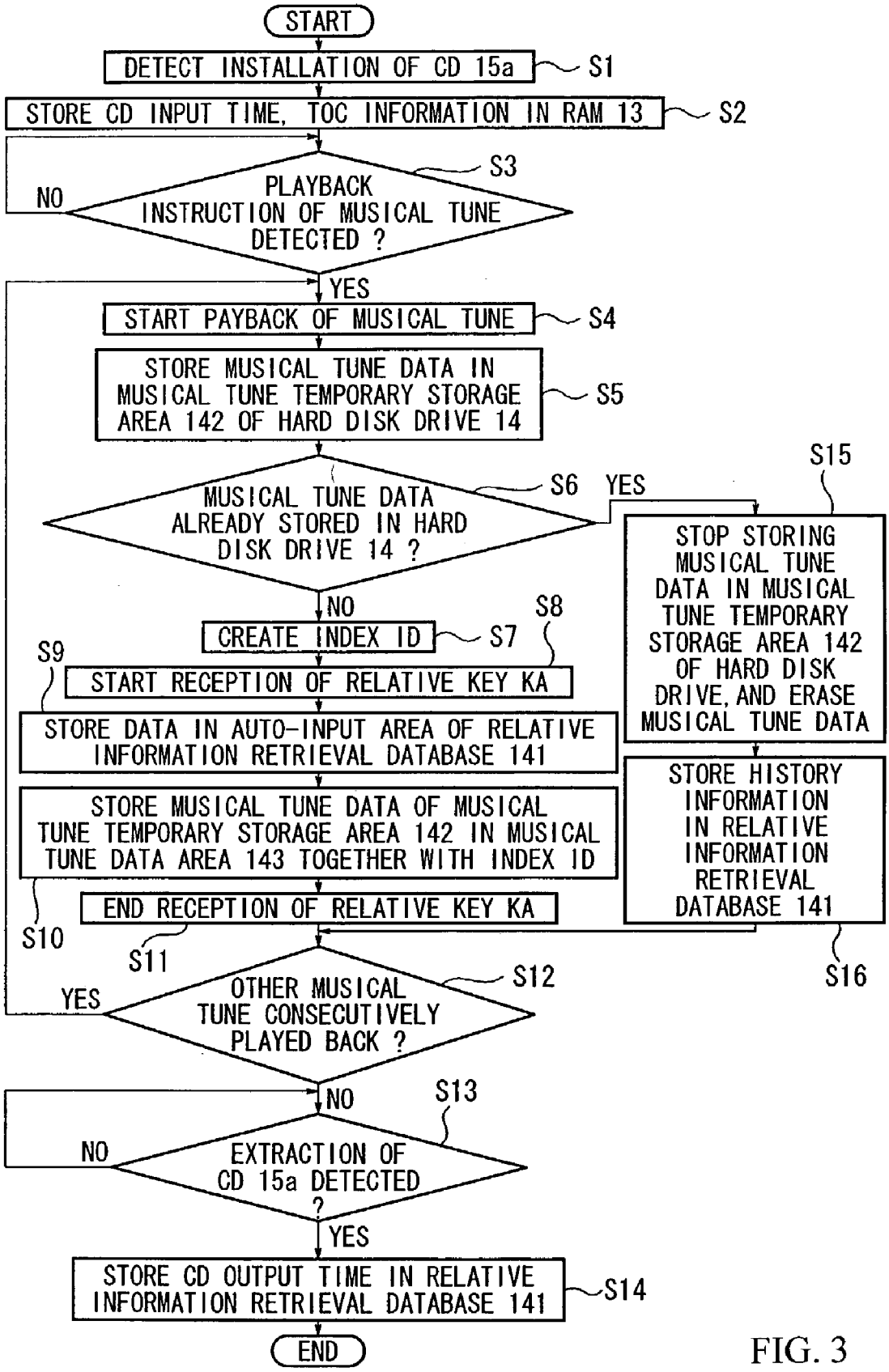
FIG. 3 is a flowchart showing a musical tune playback process for playing back musical tunes stored in a CD that is installed in a CD drive shown in FIG. 1.

FIG. 3 is a flowchart showing a musical tune playback process that is started when the CD 15*a* installed in the CD drive 15 is played back.

First, when the user installs the CD 15*a* into the CD drive 15, the CD drive 15 outputs an installation signal representing installation of the CD 15*a* to the CPU 11. Upon detection of such an installation signal (see step S1), the CPU 11 reads from the CD 15*a* the TOC information, which is stored in the RAM 13 together with a CD input time CIT in step S2.

When the user operates the input device 18 to designate playback of musical tune data, a decision result of step S3 turns to 'YES' so that the flow proceeds to step S4, wherein the CPU 11 instructs the CD drive 15 to read the designated musical tune data from the CD 15*a*. Upon receipt of a read instruction from the CPU 11, the CD drive 15 reads from plural musical tune data stored in the CD 15*a* the designated musical tune data, which are then supplied to the sound system 20. As a result, the sound system 20 reproduces the designated musical tune data, so that corresponding musical tones are produced from the speaker 203. At this time, the CPU 11 sets the time of issuing the read instruction as a musical tune playback time MPT, which is stored in the RAM 13.

In step S5, the CPU 11 starts to store the musical tune data in the musical tune temporary storage area 142 in the hard disk drive 14 at the same time when it instructs the CD drive 15 to play back the musical tune.

In step S6, a decision is made as to whether or not the musical tune data have been already stored in the musical tune data area 143 of the hard disk drive 14. Specifically, a decision is made as to whether or not the relative information retrieval database 141 has already stored musical tune data whose TOC information match the TOC information of the CD 15*a* presently played back and whose musical tune number matches the musical tune number of the musical tune presently played back.

When the musical tune data presently reproduced have not been stored in the hard disk drive 14 so that a decision result of step S6 is 'NO', the flow proceeds to step S7 in which the CPU 11 creates an index ID for identifying the musical tune data presently reproduced. That is, the CPU 11 assigns a new serial number to the disk ID, and it also recognizes a track number of the TOC information whose CD 15*a* is presently played back as a new musical tune number. Hence, the CPU 11 combines the disk ID and musical tune number to create an index ID for the musical tune data presently reproduced. Then, the index ID is stored in the relative information retrieval database 141 and is also temporarily stored in the RAM 13.

After completion of creation of the index ID, the flow proceeds to step S8 in which the CPU 11 starts to receive a relative key KA, which is used to perform an interrupt process. The relative key KA is equipped on the keyboard 18*b*.

Then, the flow proceeds to step S9 in which the CPU 11 assigns a new serial number to the CD input number CIN, which is then stored in the auto-input area of the relative information retrieval database 141 together with the TOC information, CD input time CIT, and musical tune playback time MPT.

When the CD drive 15 completes playback of a single musical tune, the flow proceeds to step S10 in which the CPU 11 transfers the foregoing musical tune data, which are temporarily stored in the musical tune temporary storage area 142 of the hard disk drive 14, to the musical tune data area 143 together with the index ID. Thus, the CPU 11 erases the musical tune data from the musical tune temporary storage area 142. Then, the CPU 11 ends reception of the relative key KA in step S11.

In contrast, when the hard disk drive 14 has already stored the foregoing musical tune data so that a decision result of step S6 is 'YES', it is unnecessary to store the musical tune data in the musical tune data area 143 again. In this case, the flow proceeds to step S15 in which the CPU 11 stops storing the musical tune data in the musical tune temporary storage area 142 of the hard disk drive 14, so that it erases the musical tune data, which may be stored halfway, from the musical tune temporary storage area 142. In step S16, the CPU 11 additionally stores the CD input number CIN, CD input time CIT, and musical tune playback time MPT in the history information stored in the relative information retrieval database 141. Then, the flow proceeds to step S12 in which a decision is made as to whether or not other musical tune data should be consecutively reproduced. If 'NO', the flow proceeds to step S13 in which a decision is made as to whether or not the CD 15*a* is extracted from the CD drive 15.

When the CD 15*a* is extracted from the CD drive 15 so that a decision result of step S13 is 'YES', the flow proceeds to step S14 in which the CPU 11 updates the CD output time COT of the preceding history information that is stored in the relative information retrieval database 141 and that has the same CD input number CIN of the extracted CD 15*a*. Thereafter, the CPU 11 ends the musical tune playback process of FIG. 3.

Incidentally, the user may designate other instructions such as 'stop', 'fast forward (FF)', and 'skip' in the middle of the playback of a musical tune, whereas these instructions are not described in detail because they do not construct essential matters of this invention.

2. Interrupt Process

Next, an interrupt process that is started when the user depresses the relative key KA of the keyboard 18*b* will be described with reference to FIG. 4.

Figure 4:
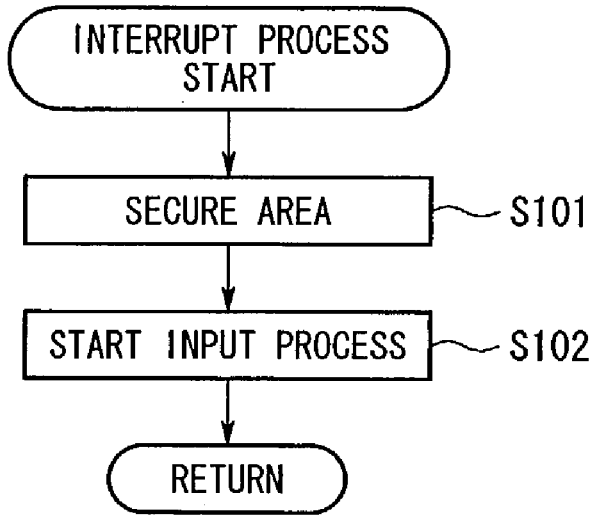
FIG. 4 is a flowchart showing an interrupt process that is started when a relative key equipped in a keyboard is depressed.
Figure 5:
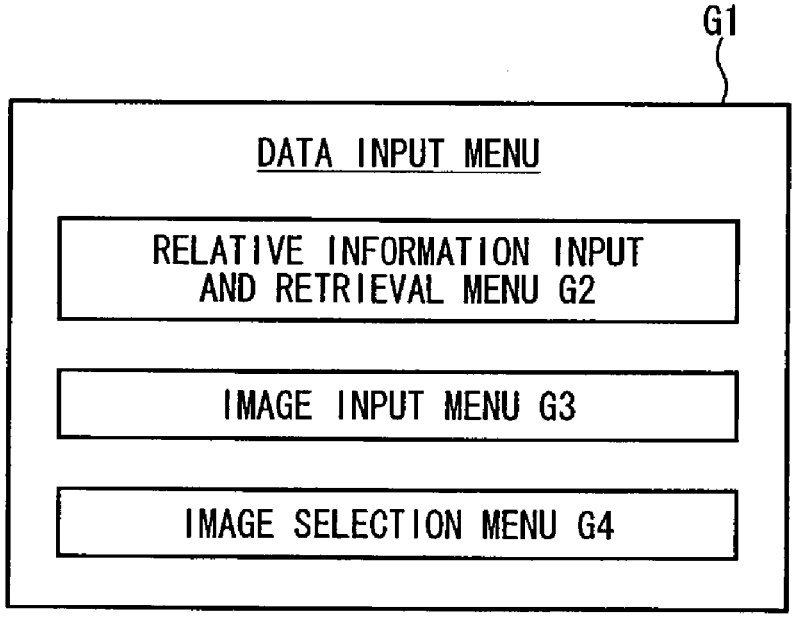
FIG. 5 shows an example of a data input menu that is displayed on the screen of a display shown in FIG. 1 upon depression of the relative key.

When the user depresses the relative key KA, the CPU 11 starts an interrupt process shown in FIG. 4, wherein it firstly secures an input area relative to the index ID stored in the RAM 13 in step S101. In step S102, the CPU 11 starts an input process to displays a prescribed image representing a data input menu G1 on the screen of the display 17 as shown in FIG. 5.

That is, upon depression of the relative key KA, the CPU 11 performs multitask processing in which the musical tune playback process and input process are performed in parallel. This allows the user to input data while listening to a musical tune played back in the musical tune playback apparatus.

3. Relative Information Input Process

Upon depression of the relative key KA, the data input menu G1 is displayed on the screen of the display 17 so as to proceed to a relative information input process and its related operations, details of which will be described below.

As shown in FIG. 5, the data input menu G1 provides three buttons with regard to three images to be displayed on the screen of the display 17, namely, "relative information input and retrieval menu (G2)", "image input menu (G3)", and "image selection menu (G4)". That is, the user selectively operates the button regarding the relative information input and retrieval menu G2 in order to input relative information regarding musical tune data; or the user selectively operates the button regarding the image input menu G3 in order to input an image relative to musical tune data.

Figure 6:
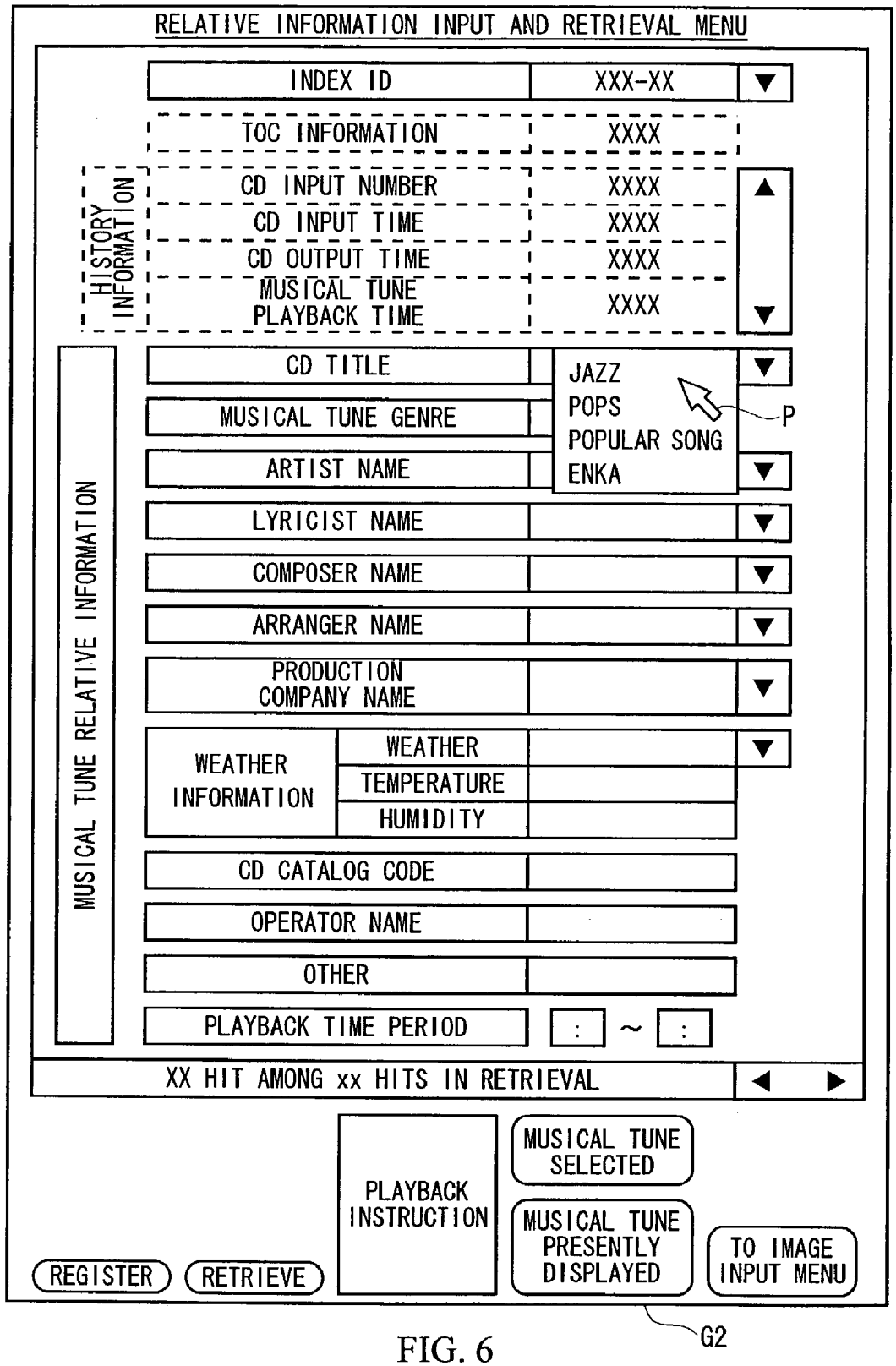
FIG. 6 shows an example of a relative information input and retrieval menu that is displayed on the screen of the display upon user's operation on the data input menu of FIG. 5.

When the user selects the uppermost button in FIG. 5, the CPU 11 controls the display 17 to display the relative information input and retrieval menu G2 on the screen as shown in FIG. 6. The upper area of this menu G2 shows various data items with regard to the index ID, TOC information, and history information, wherein contents of the relative information retrieval database 141 are described in correspondence with the index ID that is stored in the RAM 13 when playing back a musical tune.

The middle area of this menu G2 shows contents of musical tune relative information having various data items representing CD title, musical tune genre, musical tune title, artist name, lyricist name, composer name, arranger name, production company name, weather, temperature, humidity, CD catalog code, operator name, and other information, all of which are described in connection with a musical tune.

In the above, a list box listing items, each of which can be chosen using a pointer P, can be attached to each of data items whose contents may be fixed in form. For example, a list box listing "jazz", "pops", "popular song", and "enka" (i.e., Japanese traditional popular song) is attached to the musical tune genre MJ.

The user operates the mouse 18*a* or the keyboard 18*b* of the input device 18 to input characters and the like into each of the aforementioned items, which are described in connection with the musical tune relative information in the relative information input and retrieval menu G2. After completely filling the aforementioned items with characters and the like, the user operates the input device 18 to move the pointer P onto a "register" button, which is displayed in the lower area of the relative information input and retrieval menu G2. Then, the user clicks the register button with the mouse 18*a*, thus instructing registration of input information filling the aforementioned items. Thus, the CPU 11 stores the input information into the manual-input area of the relative information retrieval database 141 shown in FIG. 2.

As to the items of weather W and temperature T, data are automatically measured by the temperature sensor 19*a* and humidity sensor 19*b* of the sensor unit 19. That is, the CPU 11 reads measurement results to correspondingly describe data in the items of temperature T and humidity S in the relative information retrieval database 141.

As to the items of body temperature TA and pulse MI, data are automatically measured by the body temperature sensor 19*c* and pulse sensor 19*d* of the sensor unit 19. Herein, the CPU 11 reads measurement results when the user operates the input device 18 using the sensors 19 to designate entry of measurement results.

Figure 7:
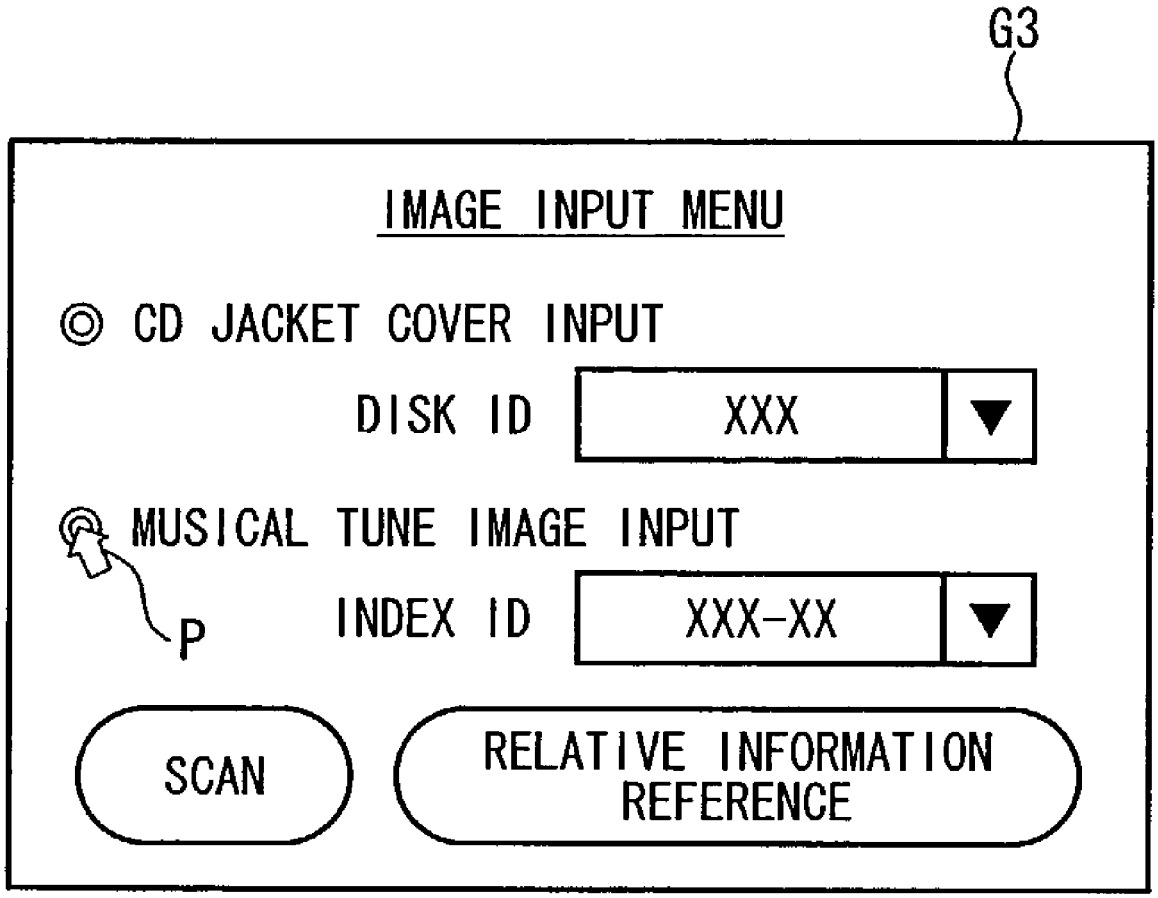
FIG. 7 shows an example of an image input menu that is displayed on the screen of the display upon user's operation on the data input menu of FIG. 5.

When the user selects the button regarding the image input menu G3 on the data input menu G1 shown in FIG. 5, the CPU 11 controls the display 17 to display the image input menu G3 on the screen as shown in FIG. 7. This image G3 contains two text boxes with regard to the disk ID and index ID, which automatically describe corresponding numerals based on the stored content of the RAM 13, wherein the disk ID is a part of the index ID stored in the RAM 13. In addition, this image G3 also contains two check boxes accompanied with prescribed character strings, namely, "CD jacket cover input" and "musical tune image input". That is, the user can select either one of these check boxes by clicking with the mouse 18*a* while correspondingly locating the pointer P thereon, for example. That is, the user is free to choose whether to input an image of a desired CD jacket cover in unit of each disk or whether to input a desired image suiting a musical tune in unit of each musical tune.

After choosing one of check boxes in the image input menu G3, the user operates the input device 18 (e.g., mouse 18*a*) to move the pointer P onto a "scan" button, wherein the user may click with the mouse 18*a*. Thus, the CPU 11 controls the scanner 16 to scan a desired picture and the like to read and produce image data, which are then stored in the image data area 144 of the hard disk drive 14 together with the disk ID or the index ID, which is described in the image input menu G3 shown in FIG. 7.

4. Musical Tune Data Reproduction Process Using Hard Disk Drive

Next, a description will be given with respect to a musical tune data reproduction process in which musical tune data stored in the hard disk drive 14 are subjected to reproduction.

Herein, the user is requested to conduct manual inputs in association with the aforementioned relative information input and retrieval menu G2, details of which will be described below.

That is, the user firstly selects the button regarding the relative information input and retrieval menu G2 on the data input menu G1 shown in FIG. 5, so that the displayed content of the display 17 is changed over from the menu G1 to the menu G2.

Upon entry of a certain time in the item of CD input time in the menu G2, the CPU 11 retrieves time data regarding the CD input time CIT from the history information of the relative information retrieval database 141 in such a way that the time period or season of each retrieved time data may substantially match or may be very close to the time period or season to which the entered time belongs, wherein the CPU 11 may find ten hits in retrieval, for example. Similarly, the CPU 11 performs retrieving operations with respect to certain times entered in the items of CD output time and musical tune playback time respectively.

Upon entry of a prescribed character string in the item of CD title in the menu G2, the CPU retrieves character data regarding the CD title CT from the relative information retrieval database 141 in such a way that the entered character string may substantially match each of retrieved character data. Similarly, the CPU 11 performs retrieving operations with respect to character strings entered in the items of musical tune genre, musical tune title, artist name, lyricist name, composer name, arranger name, production company name, CD catalog code, and other information respectively.

Upon entry of a certain time period in the item of playback time period in the menu G2, the CPU 11 retrieves time data regarding the musical tune playback time MPT from the history information of the relative information retrieval database 141 in such a way that each of retrieved time data belongs to the entered time period.

Upon entry of a character string in the item of operator name in the menu G2 without entry of the item of playback time period, the CPU 10 retrieves character data regarding the operator name IN from the relative information retrieval database 141 in such a way that each of retrieved character data may substantially match the entered character string, and the CPU 11 also retrieves time data regarding the musical tune playback time MPT from the history information of the relative information retrieval database 141 in such a way that each of retrieved time data may substantially match or may be very close to the time period or season in which the user designates retrieval, wherein the CPU 11 may find ten hits, for example.

In the above, it is possible to retrieve combinations of plural data in correspondence with entered character strings and times, for example.

It is possible to use a combination of retrieval conditions with respect to a single item in the relative information retrieval database 141. For example, it is possible to affix a prescribed symbol such as * before or after a character string that is input to a single item, wherein the character string affixed with * is regarded as a wild card to perform partial match retrieval, wherein the CPU 11 retrieve character data regarding the corresponding item from the relative information retrieval database 141 in such a way that each of retrieved character data may partially match the input character string. As to a character string that is input without affixing *, the CPU 11 performs complete match retrieval in such a way that each of retrieved character data may completely match the input character string. Of course, it is possible to introduce other retrieval conditions such as logical operations OR and AND as well as inequalities ≦ and ≧.

Suppose that as retrieval conditions, characters *love* are input to the item of musical tune title; "fine" is input to the item of weather; "≧20 AND ≧30" is input to the item of temperature; and "7:00-9:00" is input to the item of playback time period, for example. In this case, the CPU 11 retrieves data from the relative information retrieval database 141 in such a way that each of retrieved data describes the musical tune title MT including characters "love", weather W "fine", temperature T between 20° C. and 30° C., and musical tune playback time MPT belonging to "7:00-9:00".

Suppose that as retrieval conditions, characters "popular song OR pops" are input to the item of musical tune genre, and characters "Taro Yamada" are input to the item of operator name, for example. In this case, the CPU 11 retrieves data from the relative information retrieval database 141 in such a way that each of retrieved data describes the musical tune genre MJ including characters "popular song" or "pops", and operator name IN "Taro Yamada", wherein the musical tune playback time MPT may substantially match or may be very close to a time period or a season belonging to a time at which the user designates retrieval.

Further, it is possible to realize more sophisticated retrieval like an artificial intelligence (AI) in such a way that the CPU 11 retrieves a musical tune suiting user's psychological conditions (or emotional conditions), which may be determined upon measurement of user's body temperature and pulse. That is, based on measured values of user's body temperature and pulse that are measured using the body temperature sensor 19*c* and pulse sensor 19*d* of the sensor unit 19, the CPU 11 refers to a prescribed table that is stored in the ROM 12 in advance to define emotional distinctions such as "depression" and "delight". When the CPU 11 determines with reference to the table such that the user is now placed in an pre-defined emotional condition of "depression" based on readings of user's body temperature and pulse, the CPU 11 retrieves musical tune data with reference to the musical tune playback time MPT of the relative information retrieval database 141 in such a way that each of retrieved musical tune data was played back in the past during a winter season or a night time period. When the CPU 11 determines that the user is now placed in a pre-defined emotional condition of "delight", the CPU 11 retrieves musical tune data in such a way that each of retrieved musical tune data was played back in the past during a summer season or a daytime period.

The user operates the keyboard 18*b* to input data into one or plural items listed on the relative information input and retrieval menu G2. Alternatively, as to each item attached with a list box, the user operates a pointing device (e.g., mouse 18*a*) to designate a desired option in the list box with the pointer P; then, the user selects it by clicking with the mouse 18*a*. After filling prescribed items with input data in the relative information input and retrieval menu G2, the user designates a retrieve button with the pointer P and activates a retrieval command by clicking with the mouse 18*a*.

In the aforementioned data input menu G1 shown in FIG. 5, the user can conduct manual inputs in association with the image selection menu G4, details of which will be described below. Upon user's selection of the button regarding the image selection menu G4, the displayed content of the display 17 is changed over from the data input menu G1 to the image selection menu G4, wherein a list of images that are stored in the image data area 144 of the hard disk drive 14 is displayed on the screen (see FIG. 9). Herein, the user is allowed to arbitrarily select an image suiting a musical tune to be played back or an image of a CD jacket cover from among images displayed in the image selection menu G4. That is, the user operates the pointing device (e.g., mouse 18*a*) to designate a desired image with the pointer P, then, the user selects it by clicking with the mouse 18*a*. In addition, the user designates retrieval with respect to musical tune data, each of which substantially matches the selected image.

Figure 8:
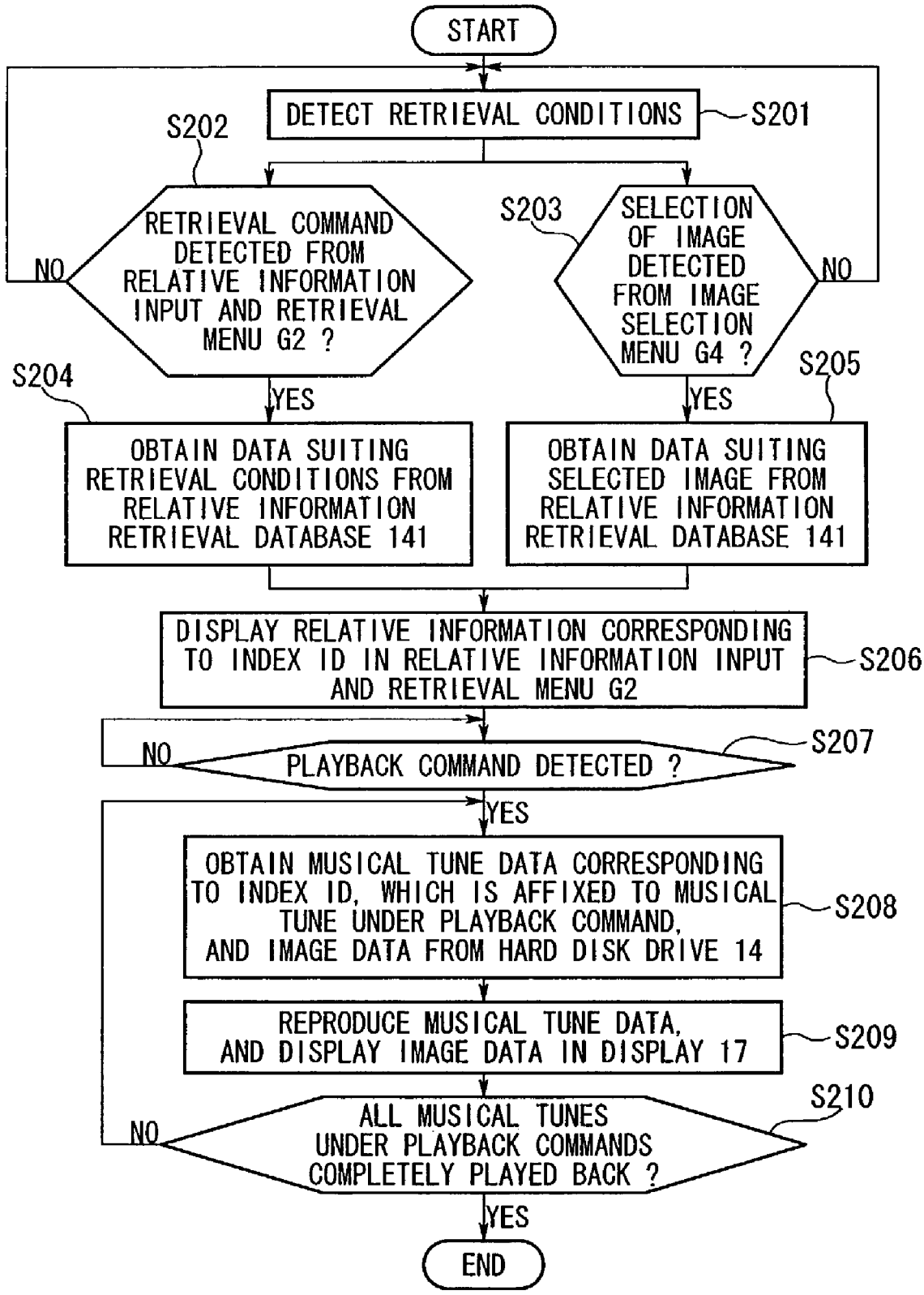
FIG. 8 is a flowchart showing a musical tune data reproduction process for reproducing musical tune data stored in the hard disk drive.
Figure 9:
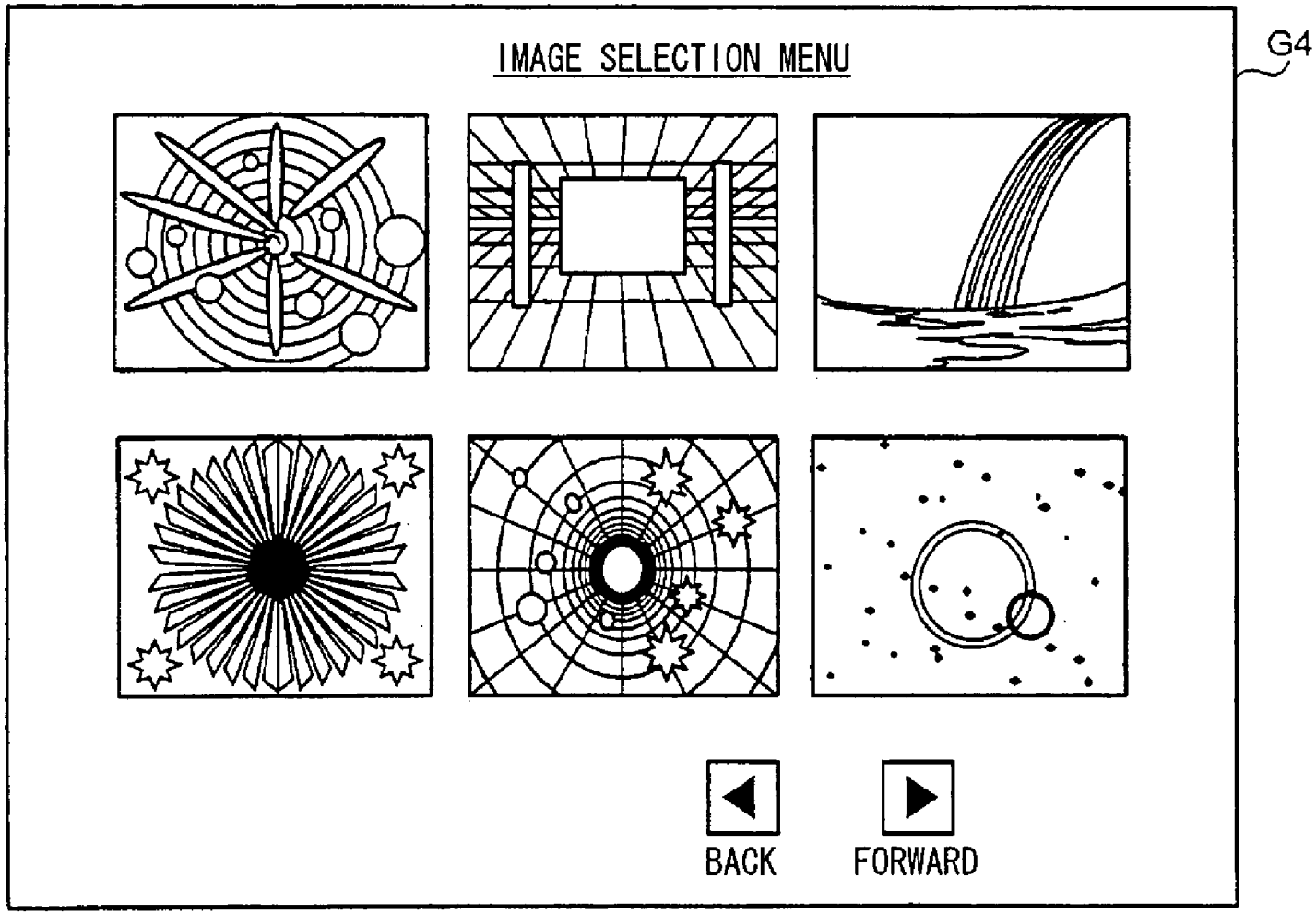
FIG. 9 shows an example of an image selection menu that is displayed on the screen of the display upon user's operation on the data input menu of FIG. 5.

FIG. 8 is a flowchart showing musical tune data reproduction process, which is performed in accordance with input retrieval conditions.

First, the CPU 11 performs detection as to whether or not a retrieval command is issued in step S201, which is linked with step S202 regarding the menu G2 and step S203 regarding the menu G4. When the CPU 11 detects a retrieval command from the relative information input and retrieval menu G2 (see FIG. 6) in which the user operates the retrieve button after inputting retrieval conditions, a decision result of step S202 turns to 'YES' so that the flow proceeds to step S204 in which the CPU 11 retrieves data suiting input retrieval conditions from the relative information retrieval database 141.

In contrast, when the CPU 11 detects a retrieval command relative to the image selection menu G4 in which the user selects image data and designates retrieval of corresponding musical tunes, a decision result of step S203 turns to 'YES' so that the flow proceeds to step S205, in which the CPU 11 obtains an index ID suiting the selected image data from the image data area 144 of the hard disk drive 14 so as to retrieve data having such an index ID from the relative information retrieval database 141.

As to an image of a CD jacket cover that is input in unit of each CD, a prescribed numeral is described only in the disk ID while no numeral is described in the musical tune number in the index ID. In this case, the CPU 11 retrieves from the relative information retrieval database 141 all data each having the same disk ID suiting the selected image.

As to an image that is input in unit of each musical tune, prescribed numerals are respectively described in the disk ID and musical tune number of the index ID. In this case, the CPU 11 retrieves from the relative information retrieval database 141 certain data (regarding a single musical tune) having the same index ID suiting the selected image.

Thus, the CPU retrieves data suiting the selected image data from the relative information retrieval database 141, wherein the retrieved data are displayed in the relative information input and retrieval menu G2 in step S206. At this time, the CPU 11 also displays a comment to read "XX hit among xx hits in retrieval" under the aforementioned items of the musical tune relative information in the menu G2 shown in FIG. 6. When there are plural hits in retrieval, the user is allowed to scroll up or down the menu G2 to visually display other relative information regarding other musical tune data that are retrieved.

In the above, the user can designate playback of a certain musical tune displayed on the screen by operating a certain button in the relative information input and retrieval menu G2 with the input device 18 (e.g., mouse 18*a*). Alternatively, the user can designate a playback order for musical tunes, which may correspond to a part of or all of retrieved musical tune data, then, the user designates playback of musical tunes, which will be sequentially played back in order.

When the user designates playback of a musical tune (or musical tunes) as described above, the CPU 11 detects it so that a decision result of step S207 turns to 'YES'. Thus, the flow proceeds to step S208 in which the CPU 11 accesses the hard disk drive 14 based on the index ID assigned to the musical tune which the user designates for playback so as to read musical tune data and the image data from the musical tune data area 143 and the image data area 144 respectively. In step S209, the musical tune data are supplied to the sound system 20, which in turn produces corresponding musical tones. In addition, the image data are supplied to the display 17, which in turn displays a corresponding image on the screen. When the CPU 11 reads plural image data from the image data area 144, the display 17 periodically changes over images, each of which is displayed on the screen in each time period (e.g., 30 sec).

When the CPU 11 reads plural musical tune data from the musical tune data area 143 so that a decision result of step S210 is 'NO', the CPU 11 repeats the foregoing steps S208 to S210, so that musical tunes are sequentially played back while images are sequentially displayed.

As described above, the musical tune playback apparatus of the present embodiment is designed to accumulate musical tune data and relative information, which the user designates playback in the past with respect to musical tunes recorded on the CD 15*a*, in the hard disk drive 14. This allows the user to easily retrieve desired musical tunes for playback from the hard disk drive 14.

C. Modifications

This invention is not necessarily limited to the present embodiment described above; hence, it is possible to arrange various modifications without departing from the scope of the invention. Next, modifications adapted to the present embodiment will be described below.

(1) To cope with words (or lyrics) contained in musical tunes, it is possible to modify the present embodiment having an ability of retrieving musical tune data based on words that are recognized from user's voices (or utterance).

That is, a words retrieval data area 145 is arranged in the data area of the hard disk drive 14 shown in FIG. 2. Herein, prior to playback of musical tune data of the CD 15*a* by the CD drive 15, words data extracted from musical tune data are stored in the words retrieval data area 145 as words retrieval data.

In addition, the musical tune playback apparatus 1 further comprises a voice input section 21, which comprises a words analysis block 211, an analog-to-digital (A/D) converter 212, and a microphone 213. Herein, microphone 213 picks up user's voices to produce analog audio signals, which are converted to digital audio signals in the A/D converter 212. Then, the words analysis block 211 recognizes words based on digital analog signals supplied from the A/D converter 212, wherein recognized words are compared with each of words retrieval data stored in the words retrieval data area 145, thus selecting words retrieval data substantially matching recognized words.

In the above, words retrieval data can be created using MIDI (Musical Instrument Digital Interface) data that are provided for karaoke systems in advance, for example. When words data representing words of a song are stored independently of musical tune data representing musical tones of a musical tune in the CD 15*a*, words data can be directly used as words retrieval data stored in the words retrieval data area 145. Incidentally, words can be input using a keyboard 18*b* instead of the microphone 213 for picking up user's voices, so that a corresponding musical tune is retrieved based on input words (or input characters).

Furthermore, the present embodiment can be modified to cope with techniques as disclosed in Japanese Unexamined Patent Publication No. 2001-75985 and Japanese Unexamined Patent Publication No. Hei 11-120198, for example. That is, the microphone 213 picks up a user's humming sound, based on which user's melody data constituted by a rhythm and a time (or beat) are created, wherein user's melody data are compared with melody data that are produced from the stored content of the CD 15*a*, so that a desired musical tune will be retrieved. Herein, user's melody data extracted from user's utterance can be added with a certain degree of obscurity (or uncertainty) to broaden a range of retrieval. Alternatively, it is possible to introduce algorithms or artificial intelligence for absorbing small differences regarding pitches and rhythms in retrieval.

In the above, melody data can be easily created using MIDI data, which are prepared for karaoke systems, for example. Instead of using the microphone 213 for picking up user's voices, it is possible to input melody information of a MIDI format, which is produced by a keyboard of an electronic musical instrument, for example.

(2) The present embodiment is designed to automatically transfer musical tune data stored in the CD 15*a* to the hard disk drive 14. Herein, it is possible to arrange a communication interface 22 in the musical tune playback apparatus 1, wherein musical tune data and relative information can be downloaded from a musical tune data distribution apparatus 24, which is a server of a specific enterprise or organization handling musical tune data distribution services, by way of a communication line 23 such as the Internet. The CPU 11 of the musical tune playback apparatus 1 instructs reproduction of downloaded musical tune data, which are transferred to the hard disk drive 14 together with relative information.

Similarly to the present embodiment, musical tune data read from the CD 15*a* are transferred to the hard disk drive 14, whereas only the relative information related to the musical tune data can be downloaded from the musical tune data distribution apparatus 24.

(3) The present embodiment is designed to play back musical tune data stored in the CD 15*a*. Of course, recording media (or digital storage media) adapted to this invention are not necessarily limited to CDs; therefore, it is possible to use other recording media storing musical tune data, such as MDs (Mini Disks), LDs (Laser Disks), DVDs (Digital Versatile Disks), and FDs (Floppy Disks), for example.

(4) The present embodiment uses the scanner 16 to input image data into the musical tune playback apparatus 1, wherein image input methods adapted to this invention are not necessarily limited to image scanning. For example, it is possible to install infrared or wireless transmission/reception functions such as IrDA (Infrared Data Association) in the musical tune playback apparatus 1, which is therefore capable of downloading image data from a prescribed server handling image data distribution via the communication line 23.

(5) The present embodiment is designed to transfer musical tune data and relative information, which are related to musical tunes played back in the past, in the hard disk drive 14. Instead of using the hard disk drive 14, it is possible to access a prescribed server handling musical tune retrieval and distribution services via the communication line 23, wherein desired musical tune data are timely transmitted to the musical tune playback apparatus 1.

(6) Retrieval of musical tune data can be performed in a composite manner using a desired combination of relative information (or character information) related to musical tune data, user's utterance, images, readings of sensors 19, and artificial intelligence techniques, for example.

(7) The present embodiment is designed in such a way that to cope with plural images related to a musical tune to be played back, the display 17 sequentially changes over images on the screen in units of prescribed time periods. Instead, it is possible to display all images, each of which is reduced in size, on the screen of the display 17.

(8) The aforementioned menus are merely examples and are not restrictive, wherein contents of the relative information input and retrieval menu G2 are not necessarily collectively displayed on the screen; therefore, it is possible to provide a relative information input menu and a retrieval menu, which are displayed independently of each other. Alternatively, it is possible to display plural menus using windows on the screen. When two displays are arranged for the musical tune playback apparatus, one of them can be specifically used for displaying images and the like. The aforementioned relative information retrieval database 141 uses specific items, data configurations, and settings of retrieval conditions, which can be modified as necessary. For example, items of relative information can be described in another database form.

(9) The present embodiment employs a specific method for determining whether or not musical tune data, which are played back, are stored in the hard disk drive 14, wherein a decision is made as to whether or not specific data having the TOC information of the CD 15*a* played back and the musical tune number of the musical tune data are described in the relative information retrieval database 141 in advance. However, the TOC information describe reduced information regarding the CD 15*a* such as track numbers and playback times, which indicates a possibility that different CDs may have the same TOC information. For this reason, it may be possible to estimate that even when played back musical tune data are not stored in the hard disk drive 14, the CPU 11 mistakenly determines that they are stored in the hard disk drive 14. To cope with such a possible drawback, the aforementioned musical tune playback process of FIG. 3 can be partially modified in such a way that when the CPU 11 determines in step S6 that musical tune data are already stored in the hard disk drive 14, the display 17 automatically displays a prescribed message requesting a user's reply as to whether or not the played back musical tune data should be stored in the hard disk drive 14 again.

(10) Prior to inputting of new musical tune data, existing musical tune data are analyzed in advance with respect to tempos, rhythms, and tone colors in units of genres. Therefore, newly input musical tune data are compared with analysis results, so that certain musical tune data whose analysis results approximate the newly input musical tune data are input to the musical tune playback apparatus.

As described heretofore, this invention has a variety of technical features and effects, which will be described below.

(1) A musical tune playback apparatus of this invention is basically constituted by a digital media drive or player handling a digital storage medium (e.g., a CD drive handling a CD), a storage (e.g., a hard disk drive, RAM), and a sound system as well as a controller (e.g., a CPU operating based on programs stored in a ROM). Herein, musical tune data stored in a digital storage medium (e.g., CD) are played back in the digital media drive and are transferred to the storage together with relative information, which is stored in a database. In accordance with retrieval conditions that are input by a user requesting retrieval of a desired musical tune, the controller retrieves musical tune data from the storage with reference to the database storing the relative information, so that retrieved musical tune data are reproduced in the sound system, which thus produces corresponding musical tones.

(2) The musical tune playback apparatus can be connected with a musical tune data distribution apparatus (e.g., a server) via a communication line, so that desired musical tune data can be downloaded to the musical tune playback apparatus. Herein, relative information related to musical tune data can be downloaded to the musical tune playback apparatus as well.

(3) When character strings are input as retrieval conditions, the controller retrieves musical tune data related to relative information, which substantially match the input character strings.

(4) When user's emotional conditions, which may be determined based on user's body temperature and pulse, are input as retrieval conditions, the controller retrieves musical tune data related to relative information, which substantially match user's emotional conditions.

(5) When user's name is input as a retrieval condition, the controller retrieves musical tune data related to relative information, which substantially matches a time period or a season in which the user's name is input.

(6) The musical tune playback apparatus can further comprises a display, wherein when image data are selected as retrieval conditions, the controller retrieves musical tune data related to relative information, which substantially matches the selected image data. Herein, image data can be picked up using a scanner and the like.

(7) When user's voices (e.g., words of a song) are input as retrieval conditions, the controller retrieves musical tune data related to relative information, which substantially matches user's voices.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A musical tune playback apparatus comprising:

a musical tune player for playing back at least one musical tune stored in a digital storage medium;

a storage for storing musical tune data corresponding to the musical tune that is played back together with relative information;

a musical tune data retriever for retrieving desired musical tune data related to the relative information, which substantially matches at least one retrieval condition; and a musical tune data reproducer for reproducing the retrieved musical tune data, wherein the musical tune data retriever retrieves desired musical tune data related to the relative information, which substantially matches a user's emotional condition that is detected as the retrieval condition based on user's body temperature and pulse.

2. A musical tune playback apparatus according to claim 1, wherein the musical tune data are transmitted from a musical tune data distribution apparatus via a communication line.

3. A musical tune playback apparatus according to claim 1, wherein the relative information regarding the musical tune data is transmitted from a musical tune data distribution apparatus via a communication line.

4. A musical tune playback apparatus according to claim 1, wherein the musical tune data retriever retrieves desired musical tune data related to the relative information, which substantially matches a character string that is input as the retrieval condition.

5. A musical tune playback apparatus according to claim 1, wherein the musical tune data retriever retrieves desired musical tune data related to the relative information, which substantially matches a user's emotional condition that is used as the retrieval condition.

6. A musical tune playback apparatus according to claim 1, wherein the musical tune data retriever retrieves desired musical tune data related to the relative information, which substantially matches a time period or a season in which a user's name is input.

7. A musical tune playback apparatus according to claim 1, wherein the musical tune data retriever retrieves desired musical tune data related to the relative information, which substantially matches image data that are input as the retrieval condition.

8. A musical tune playback apparatus according to claim 1, wherein the musical tune data retriever retrieves desired musical tune data related to the relative information, which substantially matches image data that are selected from among a plurality of preset image data as the retrieval condition.

9. A musical tune playback apparatus according to claim 1 further comprising a display for displaying an image suiting the retrieved musical tune data.

10. A musical tune playback apparatus according to claim 1, wherein the musical tune data retriever retrieves desired musical tune data related to the relative information, which substantially matches words information representing words of a song, which is recognized based on a user's utterance.

* * * * *